US007571627B2

(12) United States Patent
Yu

(10) Patent No.: US 7,571,627 B2
(45) **Date of Patent: *Aug. 11, 2009**

(54) PADLOCK

(76) Inventor: Chun Te Yu, No. 253, Sec. 3, Yanhai Rd., Fusing Township, Changhua County 506 (TW)

( * ) Notice: Subject to any disclaimer, the term of this patent is extended or adjusted under 35 U.S.C. 154(b) by 3 days.

This patent is subject to a terminal disclaimer.

(21) Appl. No.: 11/777,287

(22) Filed: Jul. 13, 2007

(65) Prior Publication Data

US 2008/0016922 A1 Jan. 24, 2008

Related U.S. Application Data

(63) Continuation of application No. 10/833,076, filed on Apr. 28, 2004, now Pat. No. 7,251,965.

(30) Foreign Application Priority Data

Jan. 20, 2004 (TW) ..... 93201230 U

(51) Int. Cl.
*E05B 37/02* (2006.01)

(52) U.S. Cl. ..... 70/21; 70/25; 70/26; 70/30; 70/49; 70/53

(58) Field of Classification Search ..... 70/21, 70/284, 285, 30, 49, 53, 20, 22, 25, 26, 31, 70/35–37, 38 R, 38 A, 38 B, 38 C, 39, DIG. 63, 70/DIG. 71

See application file for complete search history.

(56) References Cited

U.S. PATENT DOCUMENTS 1,755,521 A * 4/1930 Smith ..... 70/21
2,931,204 A * 4/1960 Check ..... 70/21
3,528,267 A * 9/1970 Orr ..... 70/21
3,823,584 A * 7/1974 Gill ..... 70/21
3,837,189 A * 9/1974 Atkinson ..... 70/21
3,879,721 A * 4/1975 Yereance ..... 70/441
4,055,972 A * 11/1977 Calegan ..... 70/21
4,730,467 A * 3/1988 Lebrecht ..... 70/25
4,918,951 A * 4/1990 Kavizky ..... 70/53
5,440,904 A * 8/1995 Su ..... 70/18
5,694,797 A * 12/1997 Kuo ..... 70/53
5,868,012 A * 2/1999 Chun-Te et al. ..... 70/30

(Continued)

FOREIGN PATENT DOCUMENTS

TW 32470 9/1980

(Continued)

*Primary Examiner*—Lloyd A Gall

(57) ABSTRACT

A padlock includes a lock body, a shackle, a first locking unit and a second locking unit. The lock body includes a first compartment, a second compartment, a first lock hole in communication with the first compartment and a second lock hole in communication with the second compartment. The first locking unit is movable in the first compartment between a locking position for locking a first end of the shackle in the first lock hole and an unlocking position for allowing the first end of the shackle to be removed from the first lock hole. The second locking unit is movable in the second compartment between a locking position for locking a second end of the shackle in the second lock hole and an unlocking position for allowing the second end of the shackle to be removed from the second lock hole.

9 Claims, 7 Drawing Sheets

U.S. PATENT DOCUMENTS

| | | | | |
|---|---|---|---|---|
| 6,227,016 | B1 * | 5/2001 | Yu | 70/30 |
| 6,408,660 | B1 * | 6/2002 | Lai | 70/30 |
| 6,539,761 | B2 * | 4/2003 | Yang | 70/284 |
| 6,708,534 | B1 * | 3/2004 | Ruan | 70/38 A |
| 6,843,080 | B1 * | 1/2005 | Yu | 70/21 |
| 6,904,776 | B1 * | 6/2005 | Lin | 70/25 |
| 7,251,965 | B2 * | 8/2007 | Yu | 70/21 |
| 2002/0088256 | A1 * | 7/2002 | Taylor et al. | 70/25 |
| 2004/0226323 | A1 * | 11/2004 | Ling et al. | 70/25 |
| 2004/0226324 | A1 * | 11/2004 | Loughlin et al. | 70/25 |
| 2005/0092036 | A1 * | 5/2005 | Lai | 70/25 |

FOREIGN PATENT DOCUMENTS

| | | |
|---|---|---|
| TW | 46563 | 9/1982 |
| TW | 369068 | 9/1999 |
| TW | 498918 | 8/2002 |

* cited by examiner

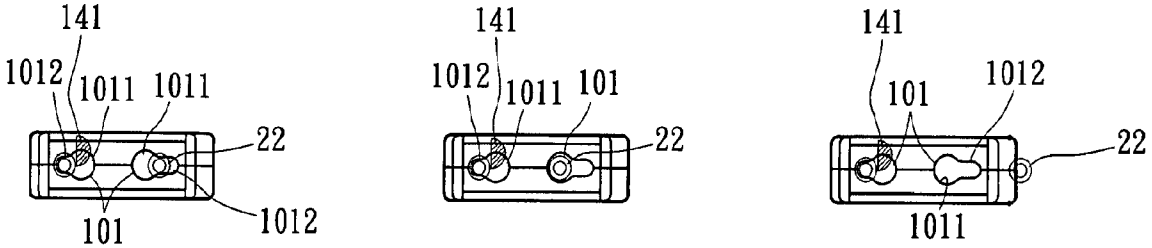
Fig. 3AA
Fig. 3BB
Fig. 3CC
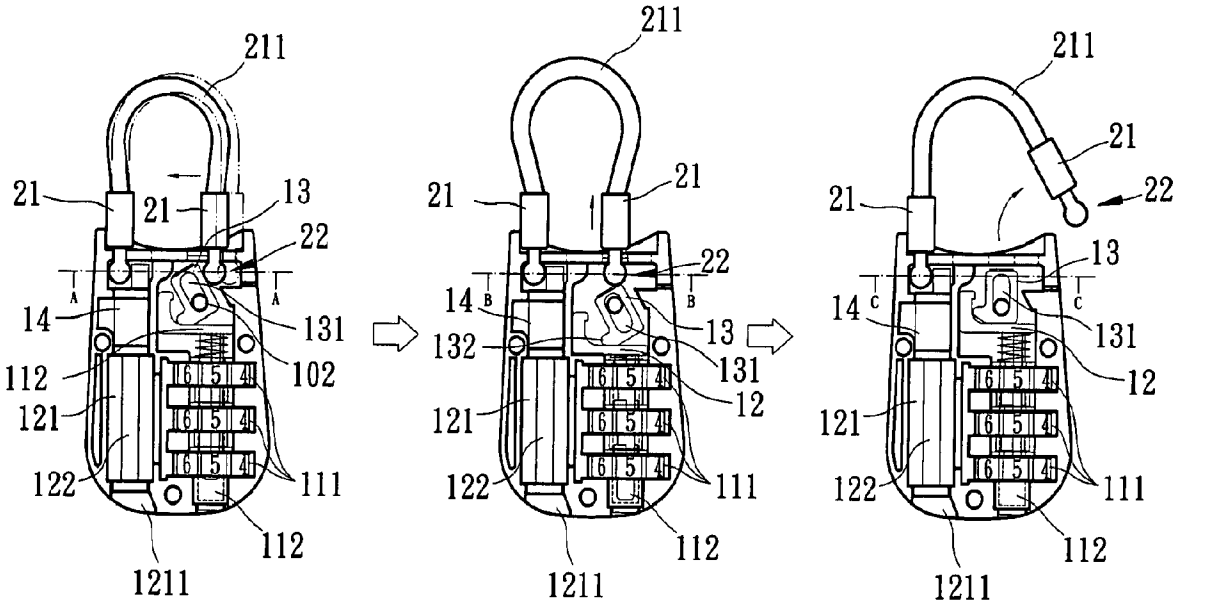
Fig. 3A
Fig. 3B
Fig. 3C

PADLOCK

CROSS-REFERENCE

The present patent application is a continuation application of U.S. patent application Ser. No. 10/833076, filed on Apr. 28, 2004, now U.S. Pat. No. 7,251,965, of which the entire disclosure is incorporated herein.

BACKGROUND OF INVENTION

1. Field of Invention

The present invention is related to a padlock and, more particularly, to a padlock with double locking effects.

2. Relate Prior Art

Padlocks include combination (or "numeral") padlocks and key-operable padlocks. The combination padlocks include a numeral-wheel type and a button type. These padlocks are used in various fields. For example, Taiwanese Patent Nos. 369068 and 498918 disclose key-operable padlocks, and Taiwanese Patent Nos. 32470 and 46563 disclose combination padlocks.

Deeming a trunk, a suitcase, a briefcase, a bag or the like suspicious, U.S. customs workers are authorized to break its lock or locks for security check. Such a damaged lock is a loss of a user and causes the user trouble and inconvenience.

To avoid the above-mentioned problems, the U.S. government regulates that lock manufacturers must provide the U.S. customs with a standard key for opening their locks. According to this regulation, several lock manufacturers all over the world are allowed to manufacture such locks.

It is therefore tried by the applicant to provide a locking apparatus which meets the regulation of the U.S. government. In case a user forgets to bring his key or forgets an unlocking number, the locking apparatus provides the user with another measure for unlocking it.

The present invention is therefore intended to obviate or at least alleviate the problems encountered in prior art.

SUMMARY OF INVENTION

It is therefore the primary objective of the present invention to provide a padlock with double effects. The padlock meets the regulation of U.S. government. In case a user forgets to bring his key or forgets the unlocking number, the padlock provides the user with another measure for unlocking it.

To achieve the primary objective of the present invention, there is provided a padlock including a lock body, a shackle, a first locking unit and a second locking unit. The lock body includes a first compartment, a second compartment, a first lock hole in communication with the first compartment and a second lock hole in communication with the second compartment. The first locking unit is movable in the first compartment between a locking position for locking a first end of the shackle in the first lock hole and an unlocking position for allowing the first end of the shackle to be removed from the first lock hole. The second locking unit is movable in the second compartment between a locking position for locking a second end of the shackle in the second lock hole and an unlocking position for allowing the second end of the shackle to be removed from the second lock hole. The first and second locking units are operable independent of each other.

The present invention can be best understood through the following description and accompanying drawings wherein:

Other objectives, advantages and features of the present invention will become apparent from the following description referring to the attached drawings.

BRIEF DESCRIPTION OF DRAWINGS

The present invention will be described by the detailed illustration of the embodiments referring to the drawings wherein:

FIG. 3A shows an unlocking operation of the padlock shown in FIG. 1;

FIG. 3AA is a cross-sectional view taken along a line A-A in FIG. 3A;

FIG. 3B shows that a first end of a shackle is moved into an aperture of a first lock hole;

FIG. 3BB is a cross-sectional view taken along a line B-B in FIG. 3B;

FIG. 3C shows that the first end of the shackle is removed from the first lock hole;

FIG. 3CC is a cross-sectional view taken along a line C-C in FIG. 3C;

FIG. 4AA is a cross-sectional view taken along a line A-A in FIG. 4A;

FIG. 4BB is a cross-sectional view taken along a line B-B in FIG. 4B;

FIG. 4CC is a cross-sectional view taken along a line C-C in FIG. 4C;

FIG. 5AA is a cross-sectional view taken along a line A-A in FIG. 5A;

FIG. 5BB is a cross-sectional view taken along a line B-B in FIG. 5B;

FIG. 5CC is a cross-sectional view taken along a line C-C in FIG. 5C;

FIG. 6AA is a cross-sectional view taken along a line A-A in FIG. 6A;

DETAILED DESCRIPTION OF EMBODIMENTS

Figure 1:
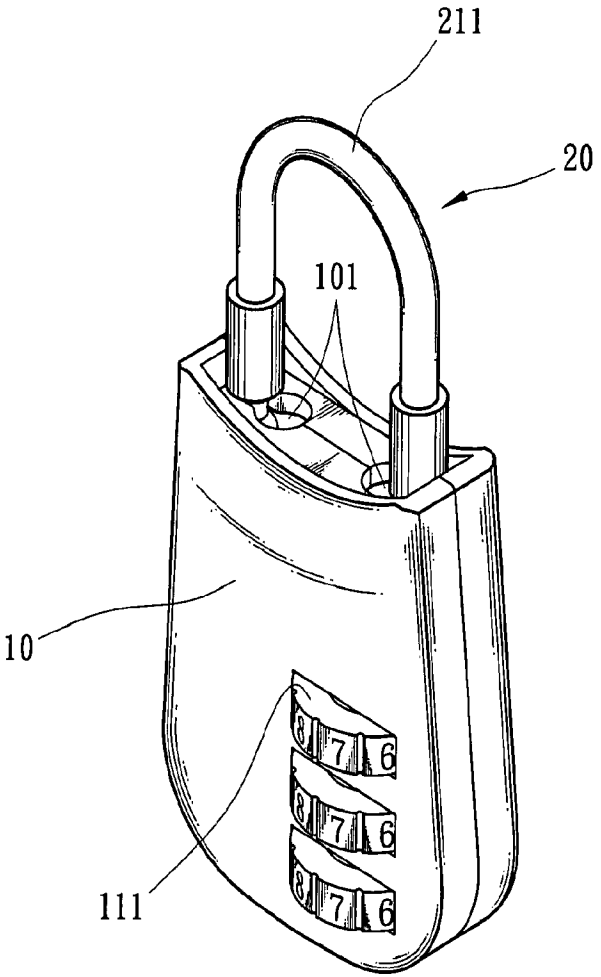
FIG. 1 is a perspective view of a padlock according to a first embodiment of the present invention.
Figure 2:
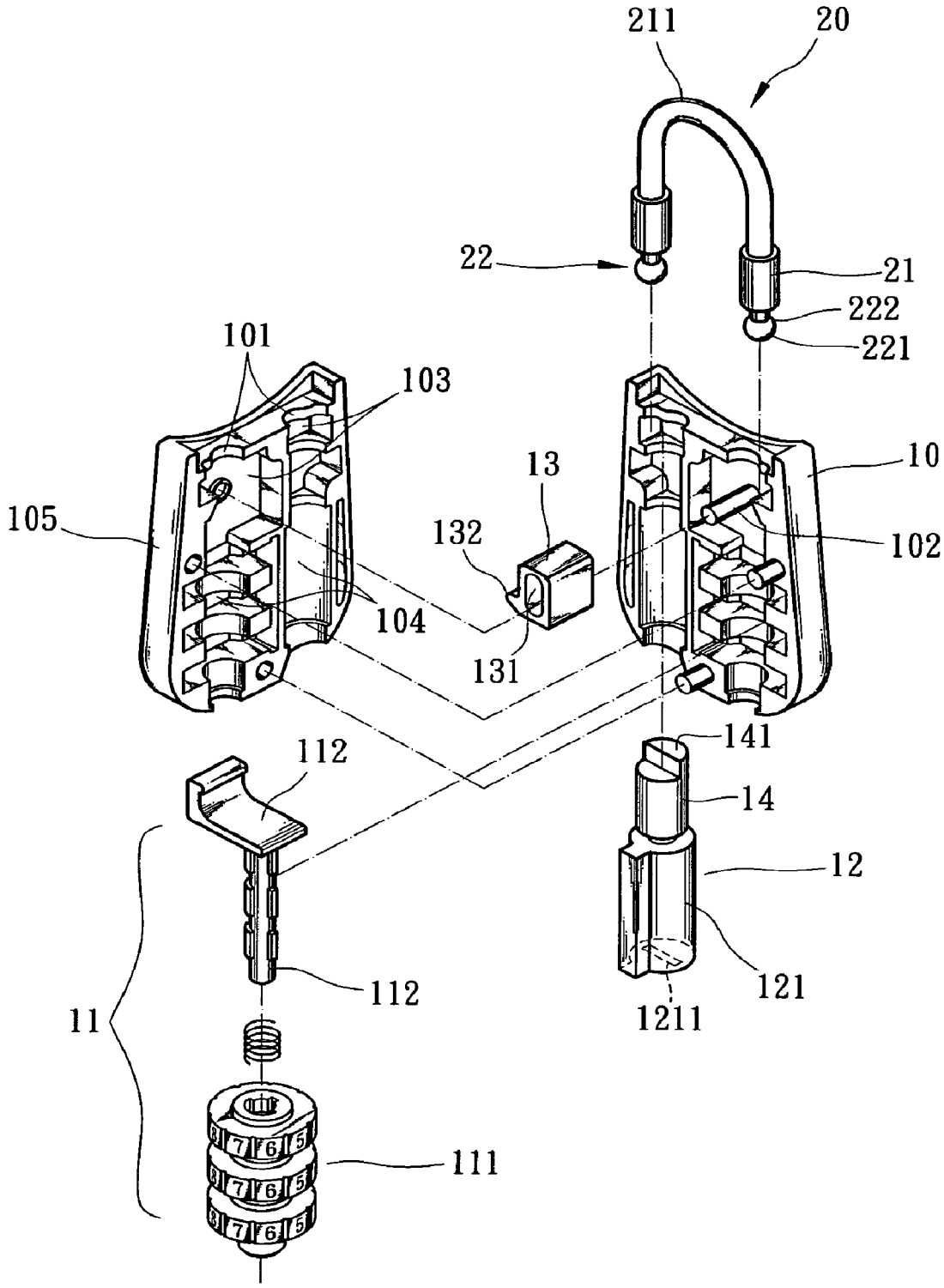
FIG. 2 is an exploded view of the padlock shown in FIG. 1.

Referring to FIGS. 1 and 2, a padlock includes a lock body 10 and a shackle 20 according to a first embodiment of the present invention. A combination locking unit 11 is disposed in the lock body 10 corresponding to a first end 21 of the shackle 20. A key-operable locking unit 12 is disposed in the lock body 10 corresponding to a second end 21 of the shackle 20.

The lock body 10 includes first and second lock holes 101 corresponding to the locking units 11 and 12, respectively. Each lock hole 101 consists of an aperture 1011 and a reduced slot 1012 in communication with the aperture 1011 (FIG. 3).

The lock body 10 consists of two halves 105 joined together. The lock body 10 includes first and second chambers defined therein. The first chamber includes an upper portion 103 in communication with the first lock hole 101 and a lower portion 104 in communication with the upper portion 103. The second chamber includes an upper portion 103 in communication with the second lock hole 101 and a lower portion 104 in communication with the upper portion 103. The locking units 11 and 12 are disposed in the lower portions 14 of the first and second compartments, respectively.

A swinging restraining block 13 is disposed in the upper portion 103 of the first compartment, above the combination locking unit 11. The swinging restraining block 13 includes a slot 131 for receiving a rod 102 extended between the halves 105 of the lock body 10, in the upper portion 103 of the first compartment. Thus, the swinging restraining block 13 can be swung left and right and moved up and down in the upper portion 103 of the first compartment. A pushing edge 132 extends from a lower end of the swinging restraining block 13.

A rotary restraining block 14 is disposed in the upper portion 103 of the second compartment, above the key-operable locking unit 12. An upper end of the rotary restraining block 14 includes an eccentric section 141. A lower end of the rotary restraining block 14 is operatively connected to the upper end of the key-operable locking unit 12. The eccentric section 141 can be rotated to block and open the aperture 1011 of the second lock hole 101.

The first and second ends 21 of the shackle 20 are movable relative to each other. A first insert 22 is connected to the first end 21 of the shackle 20. A second insert 22 is formed on the second end 21 of the shackle. Each insert 22 includes a head 221 and a reduced neck 222. The head 221 of each insert 22 can be inserted into and removed from the lock body 10 through the aperture 1011 of a related lock hole 101. The neck 222 of each insert 22 can be laterally moved in and along the slot 1012 to prevent the head 221 of the same from getting out of the lock body 10.

The combination locking unit 11 includes a numeral wheel set 111 and a driving rod 112. An upper portion of the driving rod 112 is in contact with the swinging restraining block 103. A lower portion of the driving rod 112 is inserted in and controlled by the numeral wheel set 111. When the numeral wheel set 111 is turned to a correct combination of numerals (or "unlocking number"), the driving rod 112 can be moved axially in the numeral wheel set 111. Thus, the swinging restraining block 13 can be biased and/or moved up and down to axially push the driving rod 112. On the contrary, when the numeral wheel set 111 is not turned to the unlocking number, the driving rod 112 cannot be moved axially. Under such a circumstance, the swinging restraining block 13 is stopped and prevented from being biased or moved up and down.

The key-operable locking unit 12 includes a lock sleeve 121 and a lock core 122 fitted in the lock sleeve 121 (FIG. 3). An upper end of the lock core 122 is connected to the rotary restraining block 14. A lower end of the lock core 122 includes a keyhole 1211 for receiving a key 30 for turning the key-operable locking unit 12 between a locking position and an unlocking position.

Referring to FIGS. 3A through 3CC, the numeral wheel set 111 is turned to the unlocking number so that the driving rod 112 can be moved axially in the numeral wheel set 111. Thus, the swinging restraining block 13 can be biased and/or moved up and down. When a user laterally moves the insert 22 toward the aperture 1011 of the first lock hole 101, the first insert 22 swings and lowers the swinging restraining block 13. Now, the pushing edge 132 of the swinging restraining block 13 lowers the driving rod 112. Accordingly, the swinging restraining block 13 can be pushed away from the aperture 1011 of the first lock hole 101. Hence, the first insert 22 can be removed from the lock hole 101.

On the contrary, when the numeral wheel set 111 is not turned to the unlocking number, the driving rod 112 cannot be axially moved so that the swinging restraining block 13 is restrained by the upper end of the driving rod 112. Thus, the swinging restraining block 13 continues to block the aperture 1011 of the first lock hole 101. The first insert 22 cannot cause the swinging restraining block 13 to open the aperture 1011 of the first lock hole 101. The first insert 22 is restricted in the slot 1012 of the first lock hole 101.

Figure 4A:
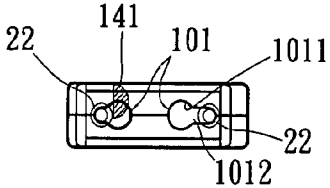
FIG. 4A shows a key-operable locking unit of the padlock in a locking state.
Figure 4B:
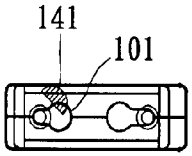
FIG. 4B shows the key-operable locking unit of the padlock in an unlocking state.
Figure 4C:
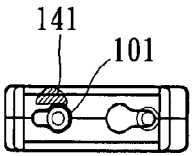
FIG. 4C shows that a second end of the shackle is removed from the second lock hole.
Figure 4A:
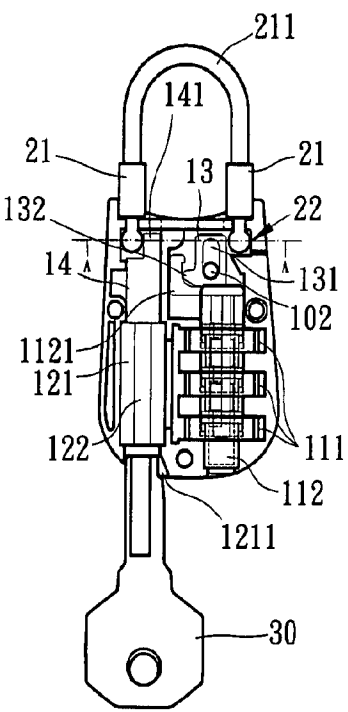
Figure 4B:
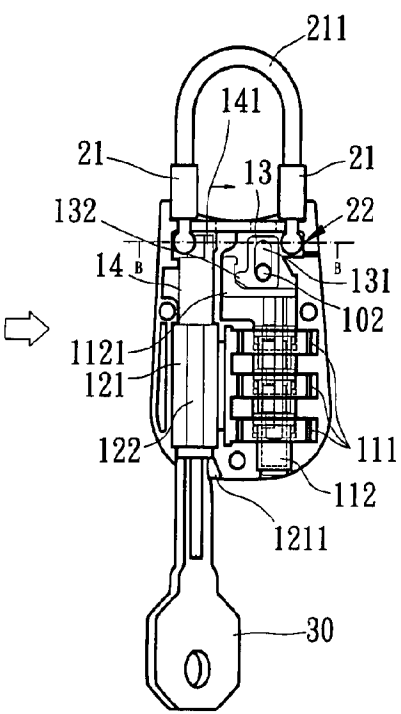
Figure 4C:
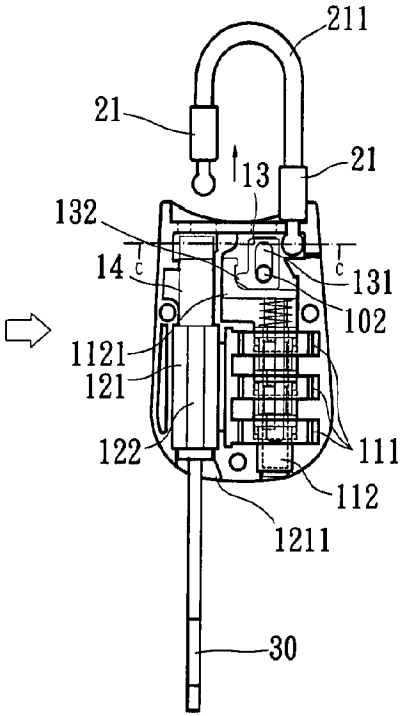

Refer to FIGS. 4A through 4CC, the key 30 is inserted in the keyhole 1211 and turned so that the lock core 122 drives the rotary restraining block 14. The eccentric section 141 does not block the aperture 1011 of the second lock hole 101, thus allowing the insert 22 to be moved from the slot 1012 to the aperture 1011 of the second lock hole 101. Then, the insert 22 can be removed from the second lock hole 101.

On the contrary, when the key 30 is turned to the locking position, the second insert 22 is restrained in the second lock hole 101 by the eccentric section 141 of the rotary restraining block 14. Therefore, the second insert 22 cannot be moved from the slot 1012 to the aperture 1011 of the second lock hole 101. Accordingly, the second insert 22 cannot be removed from the lock hole 101.

Figure 5C:
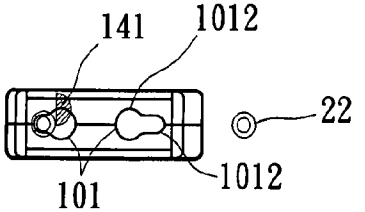
FIG. 5C shows that the first end of the link-type shackle is removed from the first lock hole.
Figure 5B:
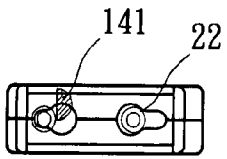
FIG. 5B shows that a first end of a link-type shackle is moved to an aperture of a first lock hole of the padlock shown in FIG. 5A.
Figure 5A:
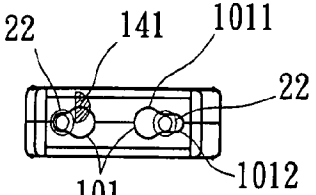
FIG. 5A shows an unlocking operation of a combination locking unit of a padlock according to a second embodiment of the present invention.
Figure 5C:
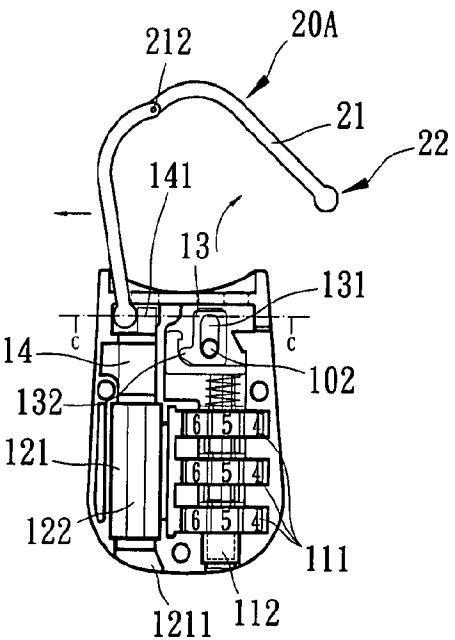
Figure 5B:
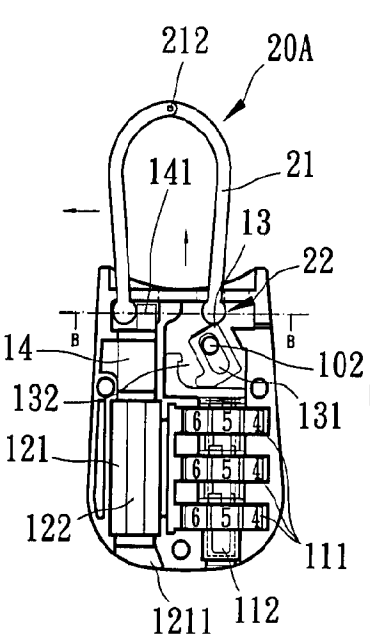
Figure 5A:
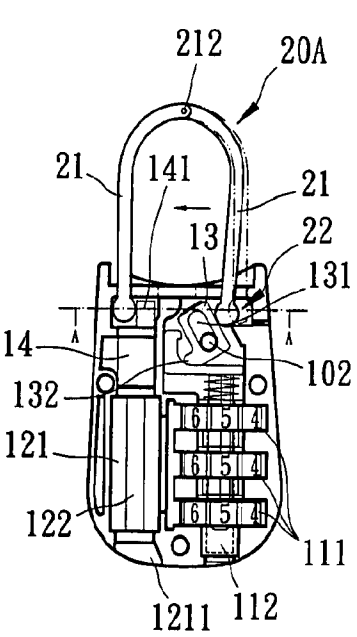

Referring to FIGS. 5A through 5CC, a shackle 20A includes first and second link-type rigid elements 21 according to a second embodiment of the present invention. Upper ends of the link-type rigid elements 21 are pivotally connected to each other by a pivot 212 so that lower ends of the link-type rigid elements 21 can be moved relative to each other. The second embodiment is otherwise identical to the first embodiment.

Figure 6A:
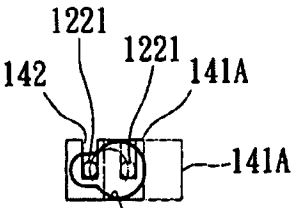
FIG. 6A shows a key-operable locking unit and a restraining block of a padlock according to a third embodiment of the present invention.
Figure 6A:
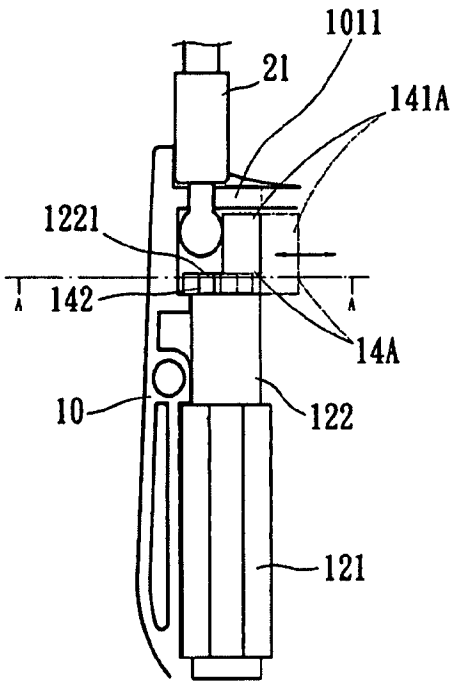

Referring to FIGS. 6A through 6AA, a padlock includes a transversely movable restraining block 14A according to a third embodiment of the present invention. An eccentric shaft 1221 is formed at the upper end of the lock core 122. The transversely movable restraining block 14A includes a channel 142 defined therein and an upright section 141A formed thereon. The third embodiment is otherwise identical to the first embodiment.

The key 30 is inserted in the keyhole 1211 and turned so that the eccentric shaft 1221 of the upper end of the lock core 122 is swung in the channel 142 to drive the transversely movable restraining block 14A. Accordingly, the upright section 141A of the transversely movable restraining block 14A does not block the aperture 1011 of the second lock hole 101, thus allowing the second insert 22 to move from the slot 1012 to the aperture 1011 of the second lock hole 101. Then, the second insert 22 can be removed from the second lock hole 101.

On the contrary, the user can use the key 30 to turn the key-operable locking unit 12 to a locking position where the second insert 22 is restrained in the lock hole 101 by the upright section 141A of the transversely movable restraining block 14A. Therefore, the second insert 22 cannot be moved to the aperture 1011 from the slot 1012 of the second lock hole 101. Accordingly, the second insert 22 cannot be removed from the second lock hole 101.

Figure 6B:
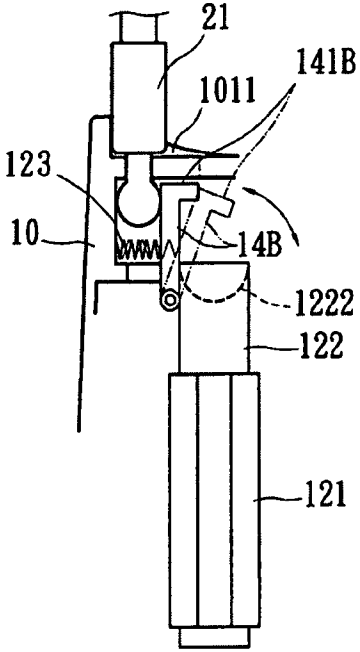
FIG. 6B shows a key-operable locking unit and a restraining block of a padlock according to a fourth embodiment of the present invention.

Referring to FIG. 6B, a padlock includes a swinging column 14B according to a fourth embodiment of the present invention. A guiding slope 1222 is formed at an upper end of the lock core 122. The swinging column 14B is controlled by the guiding slope 1222 to swing between a vertical position and an oblique position. The swinging column 14B includes a section 141B at upper end. The fourth embodiment is otherwise identical to the first embodiment.

The key 30 is inserted in the keyhole 1211 and turned to an unlocking position so that the guiding slope 1222 of the lock core 122 causes a spring 123 to bias the swinging column 14B. Therefore, the section 141B does not block the aperture 1011 of the lock hole 101 so that the second insert 22 can be moved from the slot 1012 to the aperture 1011 of the second lock hole 101 and removed from the second lock hole 101.

On the contrary, the user can use the key 30 to turn the key-operable locking unit 12 to a locking position. Therefore, the second insert 22 is restrained in the lock hole 101 by the section 141 B of the swinging column 14B. That is, the second insert 22 cannot be moved from the slot 1012 to the aperture 1011 of the second lock hole 101. Accordingly, the insert 22 cannot be removed from the lock hole 101.

Figure 6C:
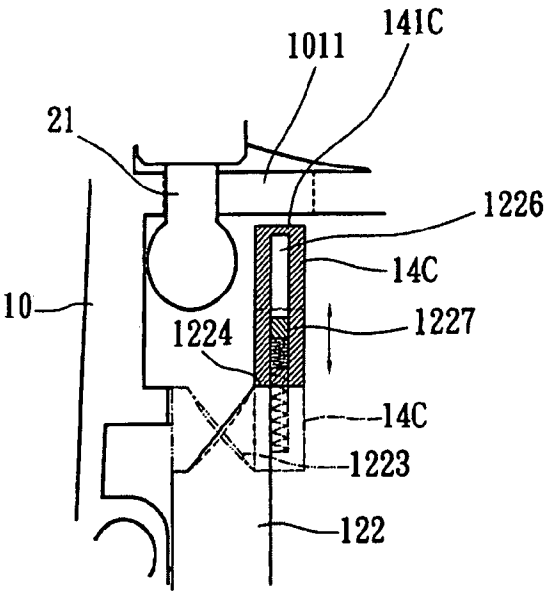
FIG. 6C shows a key-operable locking unit and a restraining block of a padlock according to a fifth embodiment of the present invention.

Referring to FIG. 6C, a padlock includes a longitudinally movable restraining block 14C according to a fifth embodiment of the present invention. A slope 1223 is formed at upper end of the lock core 122. The longitudinally movable restraining block 14C is resilient (or "spring-biased") and includes a slot 1226 for receiving a rod 1227 extended between the halves 105 of the lock body 10. A lower end of the longitudinally movable restraining block 14C is controlled by the slope 1223 to move vertically. The longitudinally movable restraining block 14C includes a section 141C at upper end. The sixth embodiment is otherwise identical to the first embodiment.

The key 30 is inserted into the keyhole 1211 and turned so that the slope 1223 of the lock core 122 allows the longitudinally movable restraining block 14C to descend. Therefore, the section 141C of the longitudinally movable restraining block 14C does not block the aperture 1011 of the second lock hole 101 so that the insert 22 can be moved from the slot 1012 to the aperture 1011 of the second lock hole 101 and removed from the lock hole 101.

On the contrary, the user can use the key 30 to turn the key-operable locking unit 12 to a locking position where an upper planar face 1224 of the lock core 122 contacts the bottom of the longitudinally movable restraining block 14C to move the longitudinally movable restraining block 14C upward. The second insert 22 is restrained in the second lock hole 101 by the section 141C of the upper end of the longitudinally movable restraining block 14C. That is, the second insert 22 cannot be moved from the slot 1012 to the aperture 1011. Accordingly, the second insert 22 cannot be removed from the second lock hole 101.

Figure 7:
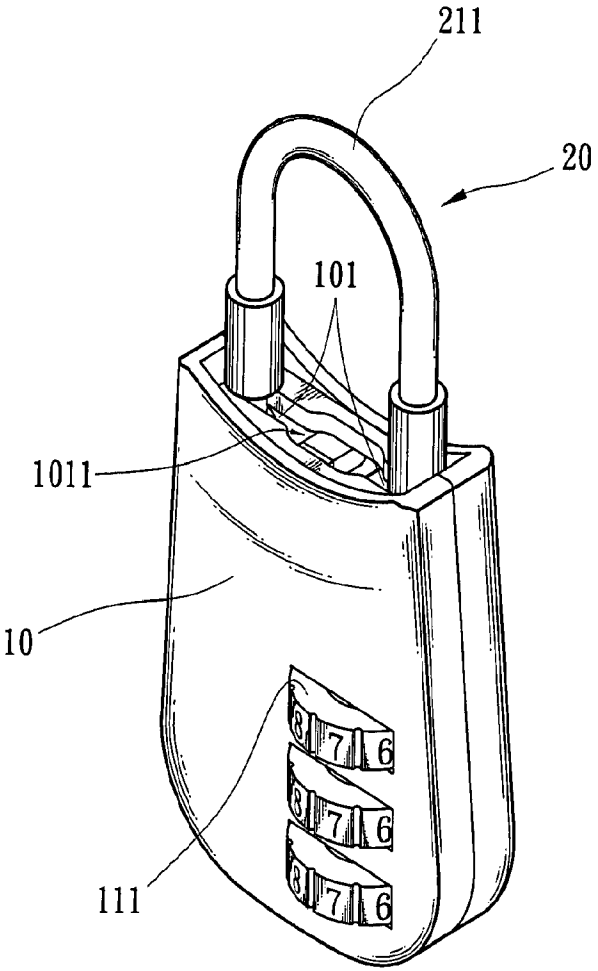
FIG. 7 is a perspective view of a padlock according to a sixth embodiment of the present invention.

Referring to FIG. 7, the apertures 1011 of the lock holes 101 are in communication with each other. That is, there is only one lock hole 101 with an aperture 1011 and two slots 1012. The sixth embodiment is otherwise identical to the first embodiment.

The present invention includes been described by the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A padlock comprising:

a lock body comprising a first lock hole and a second lock hole separate from the first lock hole;

a key-operable locking unit disposed in the lock body and configured to be operated by a key;

a combination locking unit disposed in the lock body and configured to be operated via a code; and a shackle comprising a first end for insertion in the first lock hole and a second end for insertion in the second lock hole;

wherein the first end of the shackle is controlled by the key-operable locking unit to be locked in or released for withdrawal from the first lock hole of the lock body and is independent of the combination locking unit; and the second end of the shackle is controlled by the combination locking unit to be locked in or released for withdrawal from the second lock hole of the lock body and is independent of the key-operable locking unit.

2. The padlock according to claim 1, wherein the shackle comprises a first insert formed at the first end thereof for insertion into the first lock hole and a second insert formed at the second end thereof for insertion into the second lock hole.

3. The padlock according to claim 2, wherein each of the first and second inserts comprises a neck and a head formed on the neck, and the diameter of the neck is smaller than that of the head.

4. The padlock according to claim 3, wherein each of the first and second lock holes comprises an aperture and a slot in communication with the aperture, the diameter of the aperture is larger than the width of the slot so that the head can be inserted through the aperture so that the neck can be moved into the slot, and the neck is locked in the slot by a related one of the locking units in the locking position.

5. The padlock according to claim 4 comprising a restraining block for restraining the head of an insert and therefore retaining the neck of the insert in the slot of a lock hole under the control of a locking unit.

6. The padlock according to claim 5, wherein the restraining block is a swinging restraining block comprising a longitudinal slot defined therein, and the lock body comprises a post inserted into the longitudinal slot so that the swinging restraining block is movable clockwise, counterclockwise, upwards and downwards relative to the post.

7. The padlock according to claim 6, wherein the combination locking unit comprising a numeral wheel set and a driving rod operatively connected to the numeral wheel set and formed with an end for engagement with an edge of the swinging restraining block.

8. The padlock according to claim 5 comprising a second restraining block for restraining the head of the other insert and therefore retaining the neck of the other insert in the slot of the other lock hole under the control of the other locking unit.

9. The padlock according to claim 8, wherein the second restraining block is a rotary restraining block located at an end of the other locking unit.

* * * * *